US005244468A

United States Patent [19]

Harris et al.

[11] Patent Number: 5,244,468

[45] Date of Patent: Sep. 14, 1993

[54] UREA CONTAINING INTERNALLY-CARBONATED NON-DETERGENT CLEANING COMPOSITION AND METHOD OF USE

[75] Inventors: Robert D. Harris; Steven C. Guthrie, both of Cameron Park, Calif.

[73] Assignee: Harris Research, Inc., Cameron Park, Calif.

[21] Appl. No.: 922,467

[22] Filed: Jul. 27, 1992

[51] Int. Cl.[5] ..... D06L 1/00; D06B 1/02

[52] U.S. Cl. ..... 8/137; 8/147; 8/149.1; 8/DIG. 15; 252/8.6; 252/8.8; 252/90; 252/157; 252/173; 252/174.14; 134/42

[58] Field of Search ..... 8/137, DIG. 15, 147, 8/149.1; 252/8.6, 8.8, 90, 174.14, 173, 157; 134/42

[56] References Cited

U.S. PATENT DOCUMENTS

| | | | |
|---|---|---|---|
| 3,915,633 | 10/1975 | Ramachandran | 8/137 |
| 4,035,148 | 7/1977 | Metzger et al. | 8/137 |
| 4,180,467 | 12/1979 | Barth | 252/157 |
| 4,199,482 | 4/1980 | Renaud et al. | 8/137 |
| 4,219,337 | 8/1980 | Harris | 8/137 |
| 4,561,992 | 12/1985 | Tröger et al. | 252/89.1 |
| 4,814,095 | 3/1989 | Puchta et al. | 252/8.8 |

*Primary Examiner*—Paul Lieberman
*Assistant Examiner*—Bradley A. Swope
*Attorney, Agent, or Firm*—Thorpe, North & Western

[57] ABSTRACT

Carpeting, upholstery, drapery and other textile fibers are cleaned by applying to the fibers, from a pressurized container, an aqueous effervescing internally carbonated non-detergent cleaning composition prepared by admixing, in percent by weight, about 20 to 60% of a carbonate salt, about 20 to 60% of a natural solid acid, and 5 to 40% urea in an aqueous medium such that the natural solid acid reacts with the carbonate salt to produce carbon dioxide and the solids concentration in the solution resulting from the carbonate salt, natural solid acid and urea is between about 0.5 and 10% by weight. Citric acid and sodium carbonate are the preferred solid acid and carbonate salt. The composition is prepared from naturally occurring ingredients and the container is pressurized by air or other environmentally safe gaseous materials.

23 Claims, No Drawings

UREA CONTAINING INTERNALLY-CARBONATED NON-DETERGENT CLEANING COMPOSITION AND METHOD OF USE

RELATED APPLICATIONS

This application is related to United States application Ser. No. 07/846,838 filed Mar. 6, 1992, which discloses and claims a carbonated non-detergent cleaning composition which contains weak acid/conjugate base combinations wherein the base exists as an ionic salt form of the weak acid. The non-detergent composition of the above application is externally carbonated by introduction of gaseous carbon dioxide from a pressurized cylinder.

FIELD OF THE INVENTION

This invention relates to internally carbonated non-detergent compositions for cleaning textile fibers. More particularly this invention relates to non-detergent compositions which are internally carbonated by means of an internal chemical reaction and contain as active ingredients a combination of carbon dioxide and urea. This composition has the ability to penetrate textile fibers and dissolve and/or lift both inorganic and organic materials from the fibers.

BACKGROUND OF THE INVENTION

There are myriad types of cleaning compositions for cleaning textile fibers such as carpets, upholstery, drapery, clothing, bedding, linens, and the like. Most of these are based on soaps or detergents both of which are generically referred to as "surfactants". By "detergent" is meant a synthetic amphipathic molecule having a large non-polar hydrocarbon end that is oil-soluble and a polar end that is water soluble. Soap is also an amphipatic molecule made up an alkali salt, or mixture of salts, of long-chain fatty acids wherein the acid end is polar or hydrophilic and the fatty acid chain is non-polar or hydrophobic. Detergents are further classified as non-ionic, anionic or cationic. Anionic or nonionic detergents are the most common.

Surfactants, i.e. soaps and detergents, are formulated to loosen and disperse soil from textile fibers either physically or by chemical reaction. The soil can then be solubilized or suspended in such a manner that it can be removed from the fibers being cleaned. These function because the hydrophobic ends of the molecules coat or adhere to the surface of soils and oils and the water soluble hydrophilic (polar) ends are soluble in water and help to solubilize or disperse the soils and oils in an aqueous environment. The problems associated with the use of surfactants in cleaning fibers is that large amounts of water are generally required to remove the surfactants and suspended or dissolved particles. Also, surfactants generally leave an oily hydrophobic coating of the fiber surface. The inherent oily nature of the hydrophobic end of the surfactants causes premature resoiling even when the surfaces have a surfactant coating which is only a molecule thick. Surfactants also sometimes cause irritation or allergic reactions to people who are sensitive to these chemicals. There are also environmental problems associated with the use of soaps and detergents. Some are non-biodegradable and some contain excessive amounts of phosphates which are also environmentally undesirable. Up to now however, the inherent benefits of surfactants have out weighed the disadvantages of resoiling, skin, membrane or eye irritation, allergic reactions and environmental pollution.

This concern over health and the environment has prompted an emphasis on the use of less toxic more natural cleaning components. The quest for carpet cleaning compositions that have a balance of cleanability and resoiling resistance has resulted in compositions containing unnatural components that have a greater potential to cause allergenic reaction and other health and environmental problems. Normal soaps prepared from the base hydrolysis of naturally occurring fats and oils are not suitable for carpet cleaning because of the ability of their residues to attract soils. In order to make these residues less soil attracting, detergents are synthetically modified.

Oxidative yellowing or "brown out" as it is commonly called has long been a problem in carpet cleaning. The usual conditions that increase the potential for brown out are a higher pH cleaner and/or prolonged drying times Ordinarily the higher the concentration of solids in the cleaning composition the greater the potential for this oxidative yellowing to produce a noticeable discoloration on the carpet.

A significant improvement in the art of cleaning textile fibers, and carpets and upholstery in particular, is taught in U.S. Pat. No. 4,219,333. This patent shows that, when detergent solutions are carbonated and applied to the fibers, the solution rapidly penetrates the fibers and, through the effervescent action of the carbonation, quickly lifts the suspended soil and oil particles to the surface of the fiber from which they can be removed by vacuuming or transfer to an adsorptive surface such as to a rotating pad. Moreover, because less detergent solution needs to be applied to the fibers to effect the cleaning, the fibers dry more rapidly than do fibers treated with conventional steam cleaning or washing applications and little residue is left on the fibers. Although this process is clearly advantageous over prior art methods it still requires the use of some detergent and, in some instances, added phosphates, which are undesirable in today's environmentally conscious society.

In the past, in order to prepare a carbonated solution it was necessary to pressurize the cleaning solution in a container with carbon dioxide from an outside source, e.g. a $CO_2$ cylinder, and shake the container, preferably during $CO_2$ introduction, to insure that the solution was carbonated. Carbon dioxide tanks necessary to accomplish this pressurization are heavy and inconvenient to have on site for attachment to sprayers when cleaning solution is being applied to carpets. The benefits of carbon dioxide as a volatile builder salt have out weighed the inconvenience of having a carbon dioxide tank on location during cleaning. In addition, a disadvantage of externally carbonating a solution is that excess carbon dioxide may be expelled into the air or surrounding atmosphere and there is always the danger that carbon dioxide can be expelled accidentally from the pressurized cylinder in which it is contained.

Commercial synthetic detergents also have a tendency to foam. This foaming has been found to interfere with cleaning even in carbonated solutions since the absorbent pad, as referred to above, is caused to glide over the foam rather than contact the carpet fibers. Normally additional synthetic antifoaming agents are added to cleaning solutions to prevent foaming. These antifoaming agents are normally oily and can decrease resoiling resistance.

Urea has been added to synthetic detergent compositions which contain as the active ingredients monoalkyl ethers of polyoxyalkylene glycols, monoalkyl ether of polyethylene glycol, glycerine and/or propylene glycol, disodium edetate (Soviet Union Patent 1618758, Jan. 7, 1991). Urea is an optional additive to a low temperature detergent containing nonionic or anionic surfactants and a host of other ingredients such as solvents, enzymes and the like. See for example the following German Democratic Republic Patents GDR Patents 286178, 286179, 286180, and 286181, all dated Jan. 17, 1991. German Republic Patent 4001688, Aug. 16, 1990, discloses a creamy powder containing an adsorptive organic or inorganic powder mixture, water and antistatics with 1-10% weight of urea or urea derivatives, and/or cyclic carboxamides dissolved in water. None of the above references disclose non-detergent cleaning compositions containing the combination of carbon dioxide and urea as being the active cleaning ingredients in an aqueous solution.

OBJECTS AND SUMMARY OF THE INVENTION

It is therefore an object of the present invention to provide a cleaning composition that contains only materials found in nature.

It is a further object of the present invention to provide a cleaning composition, not based on surfactants, which rapidly penetrates textile fibers removing the soils and oils therefrom with a lifting action.

It is also an object of this invention to provide a carbonated cleaning composition which rapidly penetrates textile fibers, suspending soils and oils for removal without leaving a residue on the fibers.

An additional object of this invention is to provide process for the cleaning of textile fibers with a carbonated solution wherein soils and oils are effectively removed from the fibers, without the use of surfactants, and suspended in an aqueous environment for a sufficient time to allow the suspended materials and aqueous environment to be extracted or removed from the fibers.

A further additional object of this invention is to provide a cleaning composition which is internally carbonated by chemical reaction and does not require the presence of excess amounts carbon dioxide or the use of pressurized carbon dioxide tanks or cylinders.

A yet further additional object of this invention is to provide a cleaning composition which contains urea and chemically generated carbon dioxide.

Another additional object of this invention is to provide a cleaning composition that resists resoiling and yellowing after cleaning.

These and other objects are accomplished by means of a cleaning solution which is prepared by combining an effective amount of urea, an acid or acid forming material which is natural and non-polluting to the environment (such as citric acid, succinic acid tartaric acid, adipic acid, oxalic acid, glutaric acid, etc.), and a carbonate salt that produces carbon dioxide when reacted with the acid (such as sodium carbonate, sodium percarbonate, sodium bicarbonate, lithium carbonate, lithium percarbonate, lithium bicarbonate, potassium carbonate, potassium percarbonate, potassium bicarbonate, ammonium carbonate, ammonium bicarbonate, etc.). The use of this combination of ingredients, in solution, gives a unique cleaning ability that is unexpected since there are no detergents or other cleaning agents in the solution.

The present composition removes soils and oils from fibers by suspending the soil in the solution until it can be removed. This composition is internally carbonated, thereby avoiding the extra step of carbonating the solution by external means such as highly pressurized carbon dioxide tanks. The present composition additionally does not leave soil attracting residue on the fibers and therefore does not attract or retain soils or oils which come into contact with the fibers following cleaning.

The combination of the urea with carbon dioxide produces an interactive substance that surrounds soil and oil particles, imbedded in the fibers, with negative ions allowing such particles to disperse and be suspended in the surrounding aqueous environment from which they can be removed by vacuuming or by adsorption onto a soft fabric pad or towel. The carbonation allows the solution to penetrate the fibers more rapidly and, with its accompanying effervescent action, lift the suspended particles away from the fibers for more efficient removal.

DETAILED DESCRIPTION OF THE INVENTION

The ability of a solution of a mixture of urea, an acid or acid forming materials (preferably selected from the group consisting of citric acid, succinic acid, tartaric acid, adipic acid, oxalic acid, glutaric acid, etc.), and a carbonate salt that produces carbon dioxide when reacted with the acid (preferably selected from the group consisting of sodium carbonate, sodium percarbonate, sodium bicarbonate, lithium carbonate, lithium percarbonate, sodium bicarbonate, potassium carbonate, potassium percarbonate, potassium bicarbonate, ammonium carbonate, ammonium bicarbonate, etc.) to surround and suspend soil and or hydrophobic particles such as greases, oils and the like is not believed to have been previously known or used in the cleaning arts. Such combinations, along with other ingredients, have been used in association with surfactants to control or maintain the pH of the cleaning solution. However, the use of such combinations as cleaning agents per se is novel and unexpected. The mixture of carbonate salts and acids produces carbon dioxide which associates with the urea to produce an interactive substance or complex that lifts the soil from the fabric.

While it is not known for a certainty, it is believed that the urea in the composition functions to form an overcoat over the soil and/or oil particles. The urea coating acts like a primer to which the carbon dioxide and ionic materials present in the solution either physically or chemically adhere, e.g. by hydrogen bonding, etc. In a way, the urea functions as the hydrophobic end of a detergent and the carbon dioxide and ionic materials function as the hydrophilic (polar) end of the detergent such that the soil or oil particle is surrounded and then suspended into the solution. It is not known whether the interaction between the urea and carbon dioxide actually produces a complex or just sufficient physical interaction to accomplish the cleaning purpose.

The carbon dioxide suspends the soil particles in the solution so they can be vacuumed or collected on an absorbent material.

Other additives commonly found in commercial cleaning compositions may be added without departing from the scope of this invention provided they do not interfere with the interaction of the urea with the carbon dioxide. These include bleaches, optical brighteners, fillers, fragrances, antiseptics, germicides, dyes, stain blockers and similar materials.

The carbonation of the solutions results in a rapid lifting action due to the presence of a multitude of effervescent carbon dioxide bubbles. The soils or oil on the fibers being cleaned are surrounded by the complex of carbon dioxide and urea freeing the soil which then can be lifted from the fibers into the surrounding carbonated aqueous environment. By "aqueous" is meant the presence of water but that does not suggest that copious amounts of water needs to be present. A slight dampening of the fiber may be sufficient to promote the lifting action of the effervescent carbonated solution and loosen or dislodge the soil or oil particle from the fiber. The urea and carbon dioxide interactive substance or complex holds the soil particles in suspension for a time sufficient for them to be removed from the fiber by means of vacuuming or adsorption onto a textile pad, toweling or similar adsorbent material. An important advantage of this invention is that only minimal amounts of solution are required to effect a thorough cleaning of textile fibers without leaving any residue. Normally, excess amounts of water are used to remove unwanted detergent residues.

The cleaning solution may be prepared in any desired order, e.g. by adding urea and a carbonate salt directly to a solution containing the acid and a proper amount of water, adding a carbonate salt and urea to a solution followed by the introduction of the acid, or a concentrate of ingredients consisting of urea, a solid acid and carbonate salt may first be prepared and then diluted with the desired amount of water. The containing in which the ingredients are mixed is preferably closed as soon as possible after the acid and carbonate salt start to react to take advantage of maximum carbonation in the solution. However, after mixing, the solution is pressurized by suitable means such as with a compressor, a hand pump, a pump sprayer, and the like using air, nitrogen or any other suitable gas as the pressurizing media and sprayed directly onto the fibers that are being cleaned.

The solution is prepared at ambient temperatures. However, that does not preclude the use of either lower or higher temperatures if such might be desired for any particular application. Obviously, at higher temperatures the reaction between the acid and carbonate salt will proceed to completion more rapidly, however, the carbonation of the solution may not be as complete because carbon dioxide is much more soluble at lower temperatures. Whatever degree of carbonation is attained will remain in the solution as external air or other gaseous pressure is applied from a pump or compressor in order to maintain pressure to retain the carbonation until the composition is applied to the fibers. A positive gauge pressure of between about 0.5 to 15.0 atmospheres may be applied. The pressure is not critical as long as it is sufficient to expel the carbonated cleaning solution from a pressurized container onto the surface being cleaned. If it is desired to apply the solution to fabrics at higher temperatures to enhance the activity of any ingredients, such as bleaches, optical brighteners, stain blockers and the like, this may be done without departing from the scope of the invention.

The solution is preferably applied to the textiles, particularly, carpeting or upholstery, as a spray. When so applied, as through a wand from a pressurized container, the pressure is released and the carbonated cleaning solution breaks into myriad tiny effervescent bubbles which rapidly penetrate into the textile fibers. Preferably, the solution is mechanically worked into the fibers by a carpet rake, or similar means. The effervescent action lifts the soil or oil particles to the surface of the fibers where they can be readily removed by vacuuming or adsorption onto a different, but more adsorbent textile, such as a rotating pad or piece of toweling. Because the carbon dioxide bubbles promote rapid drying, little or no solution is left on the fibers being cleaned. This contributes to the anti-resoiling properties of the invention. In addition to being a key ingredient to enhance cleaning, it is believed that urea also plays an important role in preventing yellowing, and resisting resoiling.

As stated above, the ingredients can be admixed and dissolved to make a solution in any desired order. It is the resulting carbonated solution to which the present invention is drawn. The following description is based on the mixing of all solid ingredients prior to their being dissolved to form a solution. The solid acids, carbonate salts and urea are mixed or ground together to form a solid mixture. The solid mixture contains from about 20 to 60% carbonate salts, about 20 to 60% of a natural solid acid, and from about 5 to 40% of urea by weight. Preferably the compositions will contain urea in an amount of at least 10% and most preferably 15% by weight. However, the amount of urea can be empirically adjusted according to the combination of solid acid and carbonate salt to reach an optimal amount. From the results obtained thusfar, the most preferably weight ratio of acid:carbonate salt:urea is about 1:1:0.5 or 40% acid, 40% carbonate salt and 20% urea. Obviously this ratio is not exact and any variation within about 5% either way is considered within the optimal range, i.e. 35 to 45% solid acid, 45 to 55% carbonate salt and 15 to 25% urea. The solid mixture is dissolved in water which optionally may contain other ingredients such as bleaches, optical brighteners, fillers, fragrances, antiseptics, germicides, dyes, stain blockers and similar materials. The concentration of the acids, carbonate salts, and urea in the solution are from about 0.5 to 10% and preferably between about 1 to 5% by weight. These ingredients produce a solution that is internally carbonated with good cleaning effectiveness.

The examples which follow are presented to illustrate the invention and for comparative purposes but are not to be considered as limiting as to the scope thereof.

EXAMPLE 1

A commercial carpet cleaning solution containing anionic surfactants, builder salts, antifoaming agents, and optical brighteners was prepared by admixing 170 g of a commercial concentrate with 4.5 gallons of water. The solution was externally carbonated by pressurizing from a $CO_2$ cylinder and shaking the solution to provide uniform carbonation. This formulation has been compared with hundreds of other compositions and has been found to have a superior balance of cleanability, and resistance to resoiling and yellowing. This carbonated cleaning composition has been used by an international franchise to clean millions of square feet of carpet. This solution was used as a control for comparative purposes.

EXAMPLE 2

A mixture of 200 g (1.04 moles) of citric acid with 200 g (1.89 moles) of sodium carbonate and 100 g (1.67 moles) of urea was prepared. This solid mixture was added to 4 gallons of water. Upon mixing the generation of carbon dioxide was extensive. This internally carbonated solution was pressurized with air using a compressor and sprayed onto soiled carpet samples to compare cleanability, resoiling and yellowing.

EXAMPLE 3

A mixture of 200 g of citric acid, 200 g of sodium carbonate and 20 g (0.33 moles) of urea was prepared. This solid mixture was added to 4 gallons of water and pressurized and applied to soiled carpet samples as described in Example 2.

EXAMPLE 4

A mixture of 200 g of citric acid and 200 g of sodium carbonate was prepared. This solid mixture, not containing urea, was added to 4 gallons of water and pressurized and applied to 12 the samples as described in Example 2.

EXAMPLE 5

For comparative purposes, a mixture of 10 ml of castile soap, 50 g of sodium aluminum silicate, 50 g of sodium carbonate, 80 g of sodium citrate dihydrate, 50 g of sodium borate (borax), 25 g of urea, and 1.7 ml of clove leaf oil was added to 4 gallons of water. This detergent containing solution was then externally carbonated and applied to the samples as described in Example 1. The pH was 10 before carbonation but about 7 after the addition of $CO_2$.

EXAMPLE 6

For comparative purposes a mixture of 5 ml of castile soap, 5 ml of green soap, 1.7 ml of clove leaf oil, 50 g of sodium carbonate, 80 g of sodium citrate dihydrate, 80 g of sodium aluminum silicate, 50 g of sodium borate (borax) and 25 g of urea was added to 4 gallons of water. This detergent containing solution was externally carbonated and applied to the samples as described in Example 1. The pH before carbonating was between 9.5 and 10. The mixture was milky cloudy and about 15 minutes were required to dissolve the sodium borate (borax). After the mixture was carbonated the pH was between 6 and 7.

EXAMPLE 7

A mixture of 100 g of sodium citrate dihydrate, 120 g of sodium carbonate, 100 g of sodium borate (borax), and 10 g of citric acid was added to 4 gallons of water. This non-detergent solution was externally carbonated as taught in copending application Ser. No. 07/846,838 and applied to the samples as described in Example 1. The mixture before carbonation had a pH of about 9.5 and after carbonation under 50 psig pressure was about 7.

EXAMPLE 8

A mixture of 100 g of sodium citrate dihydrate, 120 g of sodium carbonate, 100 g of sodium borate (borax), 30 g of citric acid, and 35 g of urea was added to 4 gallons of water. This non-detergent solution was externally carbonated as taught in copending application Ser. No. 07/846,838 and applied to the samples as described in Example 1. The pH was 9.5 before carbonation and 7.0–7.5 after carbonation.

EXAMPLE 9

A mixture of 100 g of sodium citrate (anhydrous), 131 g of soda ash, 100 g sodium borate (borax), 34.75 g of citric acid and 19.25 g of urea was added to 4 gallons of water. This non-detergent solution was externally carbonated as taught in copending application Ser. No. 07/846,838 and applied to the samples as described in Example 1. The pH was 9.5 before carbonation and 7.0 after carbonation.

EXAMPLE 10

A mixture of 100 g of sodium citrate dihydrate, 120 g of sodium carbonate, 100 g of sodium borate (borax), 50 g of citric acid and 15 g of sodium meta silicate was added to 4 gallons of water. This non-detergent solution was externally carbonated as taught in copending application Ser. No. 07/846,838 and applied to the samples as described in Example 1. The pH before carbonating was 9 and after carbonation the pH was 7.5.

EXAMPLE 11

A mixture of 65 g of sodium carbonate, 50 g of sodium borate (borax), 164 g of sodium citrate dihydrate, 20 g of citric acid and 19.25 g of urea was added to 4 gallons of water. This non-detergent solution was externally carbonated as taught in copending application Serial No. 07/846,838 and applied to the samples as described in Example 1. The pH was not taken before carbonation, but was about 6.5 after carbonation.

EXAMPLE 12

A mixture of 200 g of sodium citrate, 16g of sodium carbonate, 16 g of sodium borate (borax), 19.25 g of urea and 16 g of citric acid was added to 4 gallons of water. This non-detergent solution was externally carbonated as taught in copending application Serial No. 07/846,838 and applied to the samples as described in Example 1. The pH was 7 before carbonation and 6 after uniform carbonation.

EXAMPLE 13

A mixture of 100 g sodium citrate dihydrate, 131 g of sodium carbonate, 100 g of sodium borate (borax), 48.74 g of Citric acid and 19.25 g of urea was added to 4 gallons of water. This non-detergent solution was externally carbonated as taught in copending application Ser. No. 07/846,838 and applied to the samples as described in Example 1. The pH was 9.5 before carbonation and 7 after carbonation.

EXAMPLE 14

A mixture of 200 g of citric acid, 200 g of sodium percarbonate, and 100 g of urea was added to 4 gallons of water and pressurized and applied to the samples as described in Example 2. The solution was internally carbonated and the pH after carbonation was 6.2.

The solutions listed in the examples above were compared with the commercial composition in Example 1 with regard to cleanability, resoiling resistance, yellowing, and potential for toxicity (allergenic reactions, environmental harm, etc.). The pH of these solutions were all between 6 and 7 when sprayed onto I2 the carpet, but after about an hour the pH was observed to increase to between 8 and 8.5 for all solutions. Three different carpet samples were soiled with equivalent soil. Cleanability was judged by spraying each sample with the same amount of solution and rubbing an equally soiled area with a white terry cloth under a sanding block the same number of times. Resoiling was tested by submitting each sample to equivalent traffic. Yellowing was judged by carefully comparing treated samples in bright light with virgin untreated carpet. Toxicity evaluations were a subjective judgement based on the presence or absence of synthetic materials that are not found in nature. The commercial product was given the neutral rating of 0 in each of these four categories. If a solution did not perform as well as the commercial product it was given a negative value of −1, −2, −3, or −4 depending on how poor the performance was. If a solution performed better than the commercial product it was given a rating of 1, 2, 3, or 4 depending on how much better the solution performed. In other words a 4 rating would be the best or highest and a −4 rating would be the worst or lowest.

TABLE 1

TESTING OF CARBONATED CLEANING SOLUTIONS

| | Cleanability | Resoiling | Yellowing | Toxicity Potential |
|---|---|---|---|---|
| Example 1[a] | 0 | 0 | 0 | 0 |
| Example 2[b] | 3 | 3 | 0 | 4 |
| Example 3[b] | 0 | 1 | −2 | 4 |
| Example 4[c] | −2 | −3 | −4 | 4 |
| Example 5[a] | −2 | −3 | −4 | 0 |
| Example 6[a] | −2 | −2 | −2 | 0 |
| Example 7[d] | −1 | −3 | −2 | 1 |
| Example 8[d] | 0 | −1 | −1 | 1 |
| Example 9[d] | 0 | 0 | −2 | 1 |
| Example 10[d] | −1 | −2 | −1 | −2 |
| Example 11[d] | −2 | −1 | −1 | 1 |
| Example 12[d] | −1 | −2 | −2 | 1 |
| Example 13[d] | −1 | −1 | −2 | 1 |
| Example 14[b] | 3 | 3 | 1 | −2 |

[a]detergent containing
[b]within scope of invention
[c]no urea
[d]Serial No. 07/846,838

As can be readily seen, the compositions falling within the scope of the present invention clearly performed better than detergent containing compositions, carbonated non-detergents without urea and compositions as described in copending application Ser. No. 07/846,838.

EXAMPLE 15

The solutions of Examples 1 and 2 were compared on 14 actual soiled carpets in homes and apartments. Rooms were divided in half and a different solution and pad were used to clean each half. For cleanability the solution of Example 1 was judged to clean better on one carpet, on 4 carpets there was no clear difference and on 9 carpets the solution of Example 2 was better. No clear difference in yellowing could be determined. The overall result was that the internally carbonated non-detergent solution of Example 2 was best.

EXAMPLE 16

To compare the commercial solution of Example 1 with the solutions of internally carbonated non-detergent solutions of Examples 2 and 3 and the non-urea containing solution of Examples 4 thirty different carpet samples were divided into three pieces. One piece from each sample was soiled with equivalent soiling, and used in cleanability tests. The other two parts of each sample were used to test yellowing and resoiling. These samples were ranked from 1 to 5 in each of three categories with being best and 5 being worst. Cleanability was judged by spraying each sample with the same amount of solution and rubbing an equally soiled area with a white terry cloth under a sanding block 30 times. Resoiling was tested by submitting each sample to equivalent traffic. Yellowing was judged by carefully comparing treated samples in bright light with virgin untreated carpet.

TABLE 2

COMPARATIVE PERFORMANCE OF SOLUTIONS

| | Cleanability | Resoiling | Yellowing |
|---|---|---|---|
| Example 1 | 2 | 3 | 2 |
| Example 2 | 1 | 1 | 2 |
| Example 3 | 3 | 2 | 4 |
| Example 4 | 4 | 5 | 5 |
| Pure water (Control) | 5 | 4 | 1 |

The solution of Examples 1 and 2 each had samples that appeared more yellow than the other, but most had nearly equivalent yellowing therefore there was no noticeable distinction. However, it is apparent that the solutions of Examples 2 and 3 produced better overall cleaning and resoiling results than the commercial detergent solution. It is also noteworthy that the lack of urea in the non-detergent solution, (Example 4) produced inferior results and the lowered amount of urea (Example 3) as compared to Example 2 had lessened cleaning and anti-resoiling properties. However, Example 3, with less urea, still compared favorably with the commercial detergent (Example 1) in cleaning and anti-resoiling ability.

It can be seen from the above tables and examples that the chemically or internally carbonated urea containing compositions of this invention are superior to the comparative commercial cleaning composition (e.g. compare Example 1 with Example 2) and perform better than the soap containing compositions of Examples 5 and 6 or the compositions set forth in related United States application Ser. No. 07/846,838 filed Mar. 6, 1992 (comparing Examples 7–13). It is also noted from the above examples and tables that the concentration of urea is an important factor in attaining the desired cleaning and anti-resoiling properties when using the compositions of this invention (see examples 3 and 4). This concentration can be empirically adjusted within the guidelines set forth herein to obtain optimal results.

Although this invention has been described and illustrated by reference to certain specific solutions these are exemplary only and the invention is limited only in scope by the following claims and functional equivalents thereof.

We claim:

1. An internally carbonated aqueous non-detergent cleaning composition for textiles prepared by admixing, in percent by weight, (a) about 20 to 60% of a carbonate salt, (b) about 20 to 60% of a solid acid selected from the group consisting of citric acid, succinic acid, tartaric acid, adipic acid, glutaric acid, and oxalic acid, and (c) about 5 to 40% urea in an aqueous medium such that the solid acid reacts with the carbonate salt to produce carbon dioxide and the solids concentration in the solution resulting from the carbonate salt, solid acid and urea is between about 0.5 and 10% by weight; wherein the cleaning composition is maintained in a pressurized vessel under a positive gauge pressure of between about 0.5 and 15 atmospheres by means of an externally applied gas.

2. The cleaning composition of claim 1 wherein the carbonate salt is a member selected from the group consisting of sodium carbonate, sodium percarbonate, sodium bicarbonate, lithium carbonate, lithium percarbonate, lithium bicarbonate, potassium carbonate, potassium percarbonate, potassium bicarbonate, ammonium carbonate and ammonium bicarbonate.

3. The cleaning composition of claim 2 wherein the composition is prepared by admixing, in percent by weight, about 35 to 45% of the carbonate salt, about 35 to 45% of the solid acid, and about 15 to 25% urea in an aqueous medium such that the solids concentration resulting from the carbonate salt, solid acid and urea in the solution is between about 1.0 and 5.0% by weight.

4. The cleaning composition of claim 3 wherein the carbonate salt is sodium carbonate.

5. The cleaning composition of claim 4 wherein the solid acid is citric acid.

6. The cleaning composition of claim 2 wherein the aqueous medium is water.

7. The cleaning composition of claim 1 wherein said externally applied gas is air.

8. The cleaning composition of claim 7 wherein the carbonate salt is a member selected from the group consisting of sodium carbonate, sodium percarbonate, sodium bicarbonate, lithium carbonate, lithium percarbonate, lithium bicarbonate, potassium carborate, potassium percarbonate, potassium bicarbonate, ammonium carbonate and ammonium bicarbonate.

9. The cleaning composition of claim 8 wherein the composition is prepared by admixing, in percent by weight, about 35 to 45% of the carbonate salt, about 35 to 45% of the solid acid, and about 15 to 25% urea in an aqueous medium such that the solids concentration resulting from the carbonate salt, solid acid and urea in the solution is between about 1.0 and 5.0% by weight.

10. The cleaning composition of claim 9 wherein the carbonate salt is sodium carbonate.

11. The cleaning composition of claim 10 wherein the solid acid is citric acid.

12. The cleaning composition of claim 8 wherein the solid aqueous medium is water.

13. A method of cleaning textile fibers which comprises applying to said fibers, from a pressurized container maintained at a gauge pressure of from about 0.5 to 15 atmospheres by means of an externally applied gas, an aqueous effervescent, internally carbonated aqueous non-detergent cleaning composition for textiles prepared by admixing, in percent by weight, (a) about 20 to 60% of a carbonate salt, (b) about 20 to 60% of a solid acid selected from the group consisting of citric acid, succinic acid, tartaric acid, adipic acid, glutaric acid, and oxalic acid, and (c) about 5 to 40% urea in an aqueous medium such that the solid acid reacts with the carbonate slat to produce carbon dioxide and the solids concentration in the solution resulting from the carbonate salt, solid acid and urea is between about 0.5 and 10% by weight.

14. The method according to claim 13 wherein the carbonate salt is a member selected from the group consisting of sodium carbonate, sodium percarbonate, sodium bicarbonate, lithium carbonate, lithium percarbonate, lithium bicarbonate, potassium carbonate, potassium percarbonate, potassium bicarbonate, ammonium carbonate and ammonium bicarbonate.

15. The method according to claim 14 wherein the composition is prepared by admixing, in percent by weight, about 35 to 45% of the carbonate salt, about 35 to 45% of the solid acid, and about 15 to 25% urea in an aqueous medium such that the solids concentration resulting from the carbonate salt, solid acid and urea in the solution is between about 1.0 and 5.0% by weight.

16. The method according to claim 14 wherein the carbonate salt is sodium carbonate.

17. The method according to claim 16 wherein the solid acid is citric acid.

18. The method according to claim 14 wherein the aqueous medium is water.

19. The method according to claim 14 said cleaning composition is applied to said fibers in the form of a pressurized spray.

20. The method according to claim 19 wherein said textile fibers are in the form of a carpet.

21. The method according to claim 20 wherein said composition is mechanically worked into said fibers.

22. The method according to claim 21 wherein said cleaning composition along with soil particles is released from said fibers by said composition and is subsequently removed from said fibers by adsorbent means.

23. The method according to claim 14 wherein said textile fibers are in the form upholstery.

* * * * *